US005450891A

United States Patent [19]

Benthin

[11] Patent Number: 5,450,891

[45] Date of Patent: Sep. 19, 1995

[54] WINDOW SHADE MOUNTABLE ON BOTH ENDS IN SIMILAR BRACKETS

[75] Inventor: Siegfried Benthin, Bremerhaven, Germany

[73] Assignee: Benthin Aktiengesellschaft, Bremerhaven, Germany

[21] Appl. No.: 219,959

[22] Filed: Mar. 30, 1994

[30] Foreign Application Priority Data

Apr. 22, 1993 [DE] Germany ..... 43 13 125.5

[51] Int. Cl.[6] ..... A47G 5/02

[52] U.S. Cl. ..... 160/323.1; 160/903

[58] Field of Search ..... 160/323.1, 324, 325, 160/326, 903, 23.1, 66, 67, 120, 121.1, 238, 265, 319, 321; 248/251, 252, 254, 266, 267; 268

[56] References Cited

U.S. PATENT DOCUMENTS 4,399,857 8/1983 Honma ..... 160/323.1
4,729,418 3/1988 Rude ..... 160/323.1
5,029,629 7/1991 Cheng-Pei ..... 160/323.1 X
5,083,601 1/1992 Tedeschi ..... 160/323.1

*Primary Examiner*—David M. Purol
*Attorney, Agent, or Firm*—McGlew and Tuttle

[57] ABSTRACT

The present invention pertains to a window shade with a winding shaft (1), at one end of which a drive assembly is provided, and both ends of which are rotatably mounted in stationarily mounted brackets (8). So as to use identical brackets to mount the winding shaft at both ends at the end of the winding shaft (1) located opposite the drive assembly, a mount with a shaft journal (4) mounted freely rotatably in a housing (3) on the winding shaft is provided, which shaft journal (4) has, at an end projecting from the housing (3), a receiving slot of polygonal cross section, which is open on one side, for a support pin (7) of a corresponding cross section, which is provided on the bracket (8), as well as an elastically deformable locking element (5), which holds the support pin securely in the receiving slot.

14 Claims, 2 Drawing Sheets

WINDOW SHADE MOUNTABLE ON BOTH ENDS IN SIMILAR BRACKETS

FIELD OF THE INVENTION

The present invention pertains to a window shade, especially a blind, including a winding shaft at one end of which drive means are provided and wherein both ends are rotatably mounted in stationarily mounted brackets.

BACKGROUND OF THE INVENTION

The function of the drive means for the window shade, which are arranged on one side at an end of the winding shaft, requires a nonrotatable pin mounting of this end of the winding shaft. In prior-art designs, a shaft journal of polygonal cross section is used for this purpose, which is provided on an inner bearing part of the drive means and can be nonrotatably hung into a slot (which is open on the top side) of a bracket, which can be fastened to a wall or the like. A simple bearing gudgeon is usually provided at the other end of the winding shaft in prior-art designs, and this bearing gudgeon is inserted into a hole or a slot with a round bottom of a bracket provided for this end of the winding shaft, which consequently has a different design, after the shaft journal has been hung into the slot (which is open at the top) of the bracket. The different wall brackets for the two ends of the winding shaft mounting do not permit any subsequent modification of the operating side without changing the wall bracket.

A design reversed for mounting the winding shaft on the drive side with a support pin at the bracket on the wall and with a receiving slot for this support pin in an inner bearing part of the drive means of the winding shaft has been known from U.S. Pat. No. 4,372,432.

SUMMARY AND OBJECTS OF THE INVENTION

The object of the present invention is to provide possibly an identical design for both mounts of the winding shaft for the variable and reliable mounting of the window shade even on oblique and ceiling surfaces with the smallest possible light gaps.

This object is attained by the present invention by designing a window shade of the class described in the introduction including a winding shaft at one end of which drive means are provided and wherein both ends are rotatably mounted in stationarily mounted brackets and wherein a mount is provided at the end of the winding shaft, which is located opposite the drive means, with a shaft journal. The shaft journal is mounted freely rotatably in a housing on the winding shaft. The shaft journal has at an end projecting from the housing, a receiving slot. The receiving slot has a polygonal cross section and is open on one side, for a support pin of a corresponding design provided at the bracket. An elastically deformable locking element is provided for holding the support pin securely in the receiving slot.

The use of brackets of identical design for mounting both ends of the winding shaft with a small light gap between the shade and the wall brackets at both ends of the winding shaft is remarkable. The window shade can be hung simultaneously into both wall brackets from the top, it is easy to handle, and permits reliable mounting in any desired position, especially even on oblique wall or ceiling surfaces. The operating side can be subsequently changed without replacing the wall brackets.

A preferred design is one in which the shaft journal is mounted, preassembled, in a bushing, which forms the housing and is nonrotatably inserted into a front-side mount of the winding shaft. As a result, preassembly of the support elements to be connected to the winding shaft and a simple plug-type connection of these support elements to the winding shaft are made possible. According to the object of the present invention, the locking element should be movable from the locked position until the support pin in the support slot is released in relation to the shaft journal at right angles to the support slot while undergoing elastic deformation against the restoring forces generated by it. Preferred is a locking element with a handle-like fastening pin, which is arranged within the shaft journal, is inserted with the fastening pin into a correspondingly profiled recess of the shaft journal, and has an outwardly exposed handle on the circumference of the shaft journal, so that the shaft journal can be pivoted around its clamped end to release the support pin, while undergoing elastic deformation. This is best achieved by a locking element, which is L-shaped in the cross section of the receiving slot, and which extends behind the support pin in the receiving slot on the open side of the slot in the locked position. The wall bracket suitable for mounting this end of the winding shaft can also be used, if designed in the same manner, to mount the end of the winding shaft on the drive side.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS In the drawings.

DETAILED DESCRIPTION OF THE PREFERRED EMBODIMENT

Figure 4:
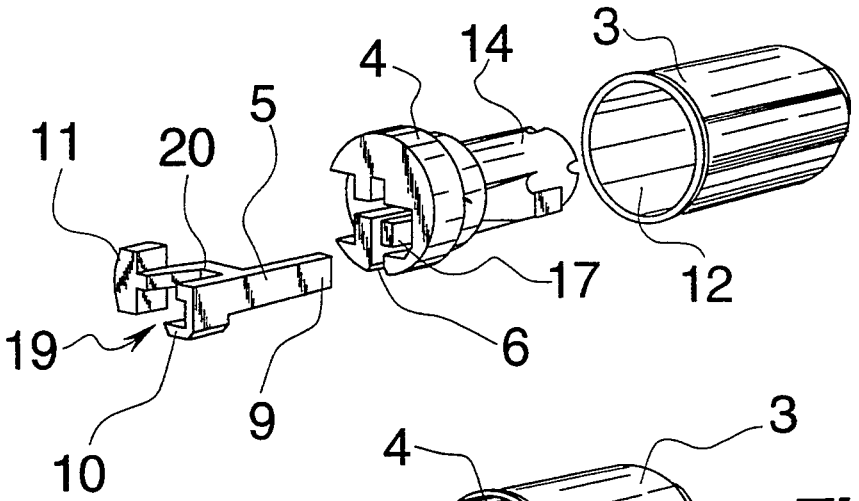
FIG. 4 is an exploded view of the elements of the mount according to FIG. 3.
Figure 3:
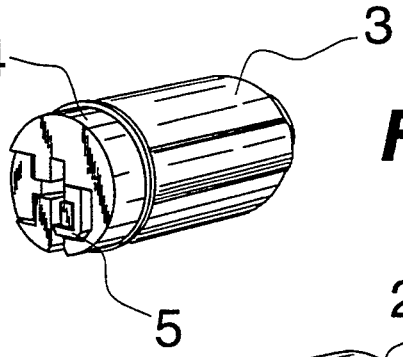
FIG. 3 is a perspective view of a mount corresponding to FIGS. 1 and 2.
Figure 2:
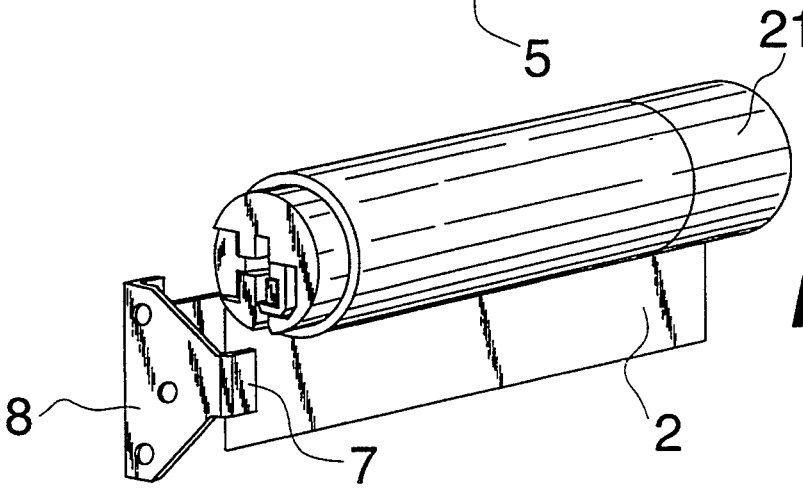
FIG. 2 is a perspective view of a mounting corresponding to FIG. 1 before final installation.
Figure 1:
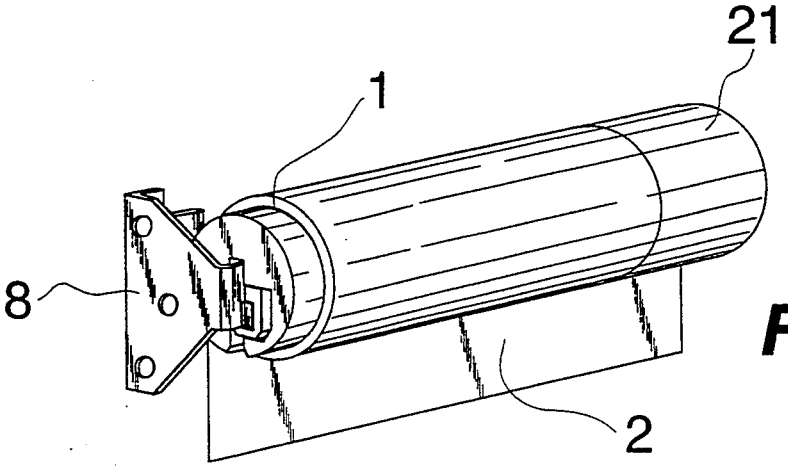
FIG. 1 is a perspective view of the mounting of the end of the winding shaft without drive means.
Figure 5:
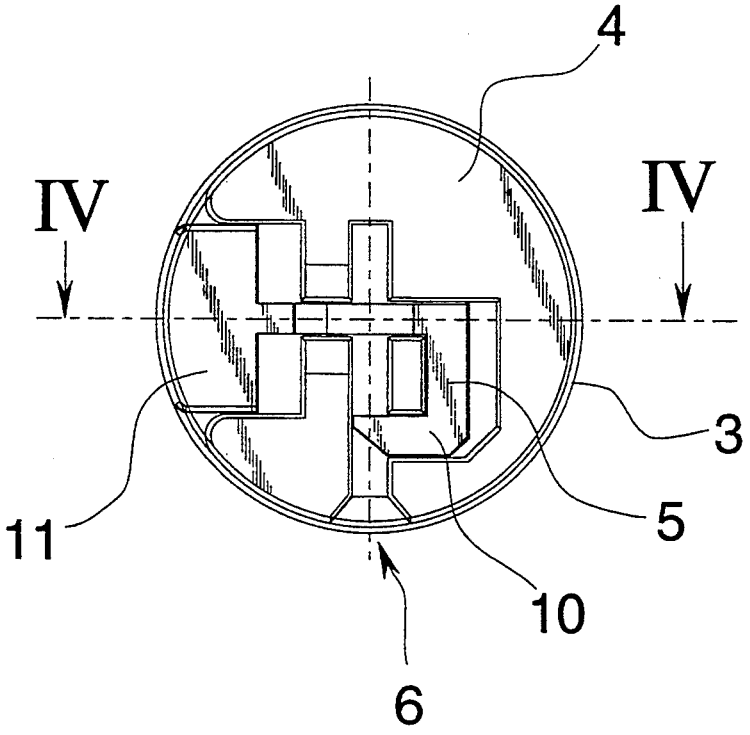
FIG. 5 is a vertical sectional view through the mount according to FIG. 3 on an enlarged scale.

Referring to the drawings in particular, the invention provides a window shade comprising a winding shaft 1 with a known driving means 21 provided at one end. The winding shaft is connected to two identically designed mounting brackets 8 as described herein.

Figure 6:
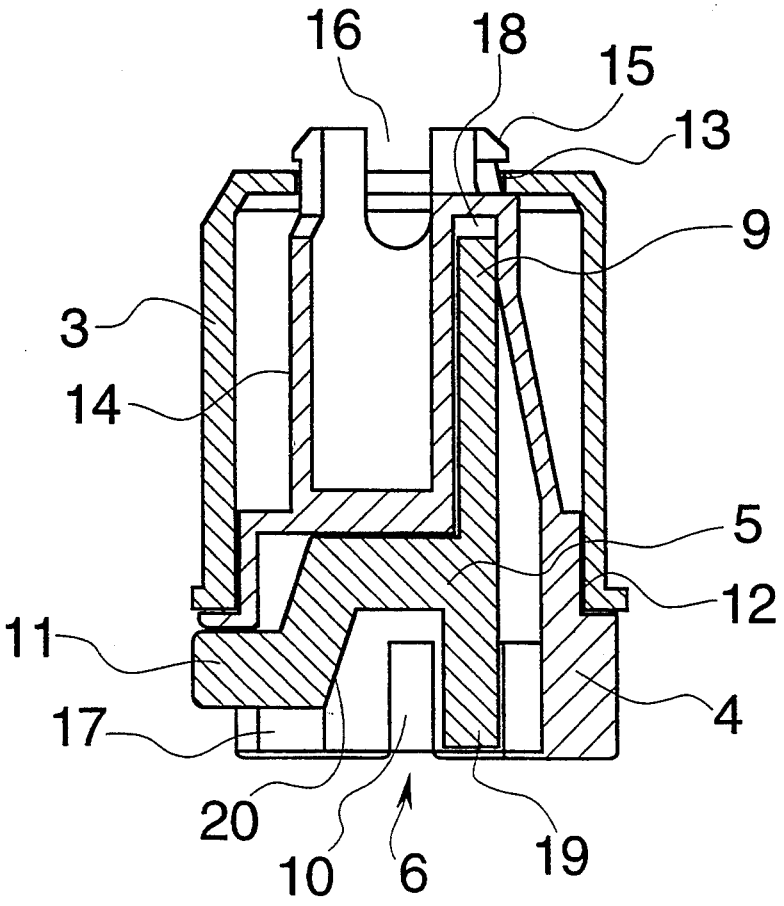
FIG. 6 is a sectional view along line IV—IV in FIG. 5.

The mount or end assembly employed by the present invention for the winding shaft 1 for a window shade 2 made of a windable material consists of a bushing-like housing 3, a shaft journal 4 freely rotatable therein, and a locking element 5. A slot 6, which is open on one side, is provided in the shaft journal 4, and the shaft journal 4 can be hung with the slot 6 onto a support pin 7, which is provided on one of the brackets 8, which can be fastened to a wall, ceiling or the like. The receiving slot 6 and the support pin 7 have the same cross-sectional profile. In the exemplary embodiment, the shaft journal 4 is mounted freely and rotatably in a bushing forming the housing 3. The shaft journal 4 is at the same time secured in the housing against axial displacement in relation to one another. The housing 3 defines a first aperture 12 and a second aperture 13, as shown in FIG. 6. The shaft journal 4 has a tail portion 14 which is inserted into the first aperture 12. At the very end of the tail portion 14 are catches 15 which have a diameter which is larger than a diameter of the second aperture 13. The catches 15 define cutouts 16 and the shaft journal 4 is inserted into the housing 3 until the catches 15 are pushed through the second aperture 13. The catches 15 secure the shaft journal 4 inside the housing 3. The catches 15 and cutouts 16 allow for easy assembly of the shaft journal 4 inside the housing 3, and also allow the shaft journal 4 and housing 3 to be preassembled before further assembly of the window shade. The housing 3 can be nonrotatably inserted into a front-side support of the winding shaft 1, so that the rotary movement which takes place during the opening and closing of the shade is between the housing 3 and the support surface at the shaft journal 4. The shaft journal 4 defines an internal cavity which is opened at end 17. The cavity has a holding pocket 18. A fastening end 9 of the locking element 5 is tightly inserted into the holding pocket 18 so that there is little, if any, play between the fastening end 9 and the holding pocket 18. The cavity expands from the holding pocket 18 to the opening 17 to allow for movement of a moving end 19 of the locking element 5. The moving end 19 of the locking element 5 is movable in a radial direction of the winding shaft 1. When the moving end 19 of the locking element 5 is moved at right angles to the receiving slot 6 the material of the locking element between the moving end 19 and the fastening end 9 undergoes elastic deformation which tends to force the moving end 19 back to its original position. In the area of the receiving slot, the locking element 5 has an L-shaped design when viewed in the axial direction of the winding shaft 1. The fastening end 9 is positioned offset from the center in the radial direction from the slot 6. The L shaped design has a leg 10 which extends into the receiving slot 6. The leg 10 extends in a locked position behind the support pin 7 of the bracket 8, when the support pin 7 is introduced into the receiving slot 6. On the circumference of the shaft journal 4, the said locking element 5 has a handle 11, so that the locking element 5 can be moved, by using the handle 11, radially in the inward direction at right angles to the slot 6, into an unlocked position. This causes the fastening end 9 to undergo elastic deformation, and also restoring forces against the side are built up at the same time. Thus the leg 10 can be pushed back from the area of the slot 6 to release the support pin 7. To introduce the support pin 7 into the slot 6, the front end of the leg 10 is beveled, so that the locking element 5 will automatically yield during a movement of the support pin 7 against the oblique surface, and the support pin 7 will be automatically locked in the receiving slot 6. The locking element 5 also has a handle 11 mounted on the moving end 19. The handle 11 is preferably connected by a dog leg 20 to the rest of the locking element 5. The dog leg is shaped so that the slot 6 and the pin 7 of the bracket can pass between the handle 11 and the leg 10. To lift off the mount from the support pin 7 of the bracket 8, the locking element is pressed to the side by exerting radial pressure on the handle 11, so that the leg 10 of the locking element 5 is pushed back from the receiving slot 6.

The brackets 8 are of identical design with support pins 7 and are provided to mount both ends of the winding shaft 1.

While a specific embodiment of the invention has been shown and described in detail to illustrate the application of the principles of the invention, it will be understood that the invention may be embodied otherwise without departing from such principles.

What is claimed is:

1. A window shade with a winding shaft drive means at one end of the winding shaft, both ends of the winding shaft being rotatably mounted in brackets, the window shade comprising:

a shaft journal provided at an end of said winding shaft located opposite said drive means;

a housing mounted on the winding shaft, said housing having an opening with said shaft journal mounted freely rotatably therein, said shaft journal having an end projecting from said housing with a receiving slot, said receiving slot having a polygonal cross section and being open on one side;

a support pin extending from one of said mounted brackets, said support pin having a shape corresponding to said receiving slot; and elastically deformable locking means for holding said support pin securely in said receiving slot.

2. A window shade according to claim 1, wherein:

said housing forms a bushing, said shaft journal being mountable in said bushing, said housing being nonrotatably inserted into a front side support of said winding shaft, said shaft journal being mountable in said bushing before said housing is inserted into said winding shaft.

3. A window shade according to claim 1, wherein:

said locking means can be moved from a locked position to release said support pin in said receiving slot from the shaft journal in a direction at right angles to the receiving slot, said locking means undergoing elastic deformation and generating restoring forces against movement from said locked position.

4. A window shade according to claim 2, wherein:

said locking means can be moved from a locked position to release said support pin in said receiving slot from the shaft journal in a direction at right angles to the receiving slot, said locking means undergoing elastic deformation and generating restoring forces against movement from said locked position.

5. A window shade according to claim 1, wherein:

said locking element means is positioned within said shaft journal and includes a lever positioned on a circumference of said shaft journal.

6. A window shade according to claim 1, wherein said locking element means has an L-shaped position provided in a cross section of said receiving slot and extending in a locked position, with a leg, behind said support pin in said receiving slot on an open side of said slot.

7. A window shade according to claim 1, wherein:

said mounted brackets are identical.

8. A window shade end assembly comprising:

a housing mountable on an end of a winding shaft of a window shade;

a shaft journal rotatably mounted in said housing, said shaft journal defining a cavity, a portion of said cavity forming a receiving slot;

a bracket including a support pin insertable into said receiving slot, said support pin having a shape which is nonrotatable in said receiving slot;

locking means positioned in said cavity and for both locking and unlocking said support pin in said receiving slot.

9. An assembly in accordance with claim 8, wherein:

said cavity forms a holding pocket;

said locking means includes a fastening end insertable into said holding pocket, said locking means also includes a moving end substantially opposite said fastening end, said moving end being movable in a radial direction of the winding shaft in said cavity between a locked position and an unlocked position.

10. An assembly in accordance with claim 9, wherein:

said locking means also includes a leg positioned in said receiving slot in said locked position, and said leg being positioned out of said receiving slot in said unlocked position.

11. An assembly in accordance with claim 9, wherein:

said locking means is elastically deformable between said moving end and said fastening end during movements between said locked and unlocked position, said elastic deformation biasing said moving end in said locked position.

12. An assembly in accordance with claim 10, wherein:

said locking means includes a handle positioned on a circumference of said shaft journal, said handle being movable by an operator to move said moving end from said locked position into said unlocked position.

13. An assembly in accordance with claim 10, wherein:

said leg includes a beveled surface to move said moving end from said locked position into said unlocked position when said support pin is slid into said receiving slot.

14. An assembly in accordance with claim 8, wherein:

said housing defines first and second apertures;

said shaft journal is insertable through said first aperture and said shaft journal includes a tail portion insertable through said second aperture, said tail portion includes a catch for securing said shaft journal to said housing in an axial direction.

* * * * *